US007028479B2

(12) United States Patent
Gobrecht et al.

(10) Patent No.: US 7,028,479 B2
(45) Date of Patent: Apr. 18, 2006

(54) METHOD AND DEVICE FOR OPERATING A STEAM TURBINE COMPRISING SEVERAL NO-LOAD OR LIGHT-LOAD PHASES

(75) Inventors: Edwin Gobrecht, Ratingen (DE); Juergen Havemann, Muelheim A.D. Ruhr (DE); Norbert Henkel, Duesseldorf (DE); Michael Wechsung, Muelheim A.D. Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 313 days.

(21) Appl. No.: 10/296,822

(22) PCT Filed: May 18, 2001

(86) PCT No.: PCT/EP01/05747

§ 371 (c)(1),
(2), (4) Date: May 20, 2003

(87) PCT Pub. No.: WO01/92689

PCT Pub. Date: Dec. 6, 2001

(65) Prior Publication Data

US 2004/0088984 A1 May 13, 2004

(30) Foreign Application Priority Data

May 31, 2001 (EP) ..... 00111692

(51) Int. Cl.
*F01K 13/02* (2006.01)

(52) U.S. Cl. ..... 60/646; 60/657; 60/663

(58) Field of Classification Search ..... 60/646, 60/657, 660, 662, 663

See application file for complete search history.

(56) References Cited

U.S. PATENT DOCUMENTS

| | | | | |
|---|---|---|---|---|
| 3,173,654 | A | 3/1965 | Roe | |
| 4,166,221 | A * | 8/1979 | McGaha et al. | 290/40 R |
| 4,258,424 | A * | 3/1981 | Giras et al. | 700/290 |
| 4,402,183 | A * | 9/1983 | Dimitroff et al. | 60/660 |
| 4,589,255 | A | 5/1986 | Martens et al. | |
| 4,891,948 | A * | 1/1990 | Kure-Jensen et al. | 60/645 |
| 5,018,356 | A | 5/1991 | Silvestri | |
| 5,333,457 | A * | 8/1994 | Silvestri, Jr. | 60/646 |

FOREIGN PATENT DOCUMENTS

| | | |
|---|---|---|
| DE | 920 548 | 3/1954 |
| DE | 1 046 068 | 5/1957 |
| DE | 44 38 835 | 10/1994 |
| JP | 60119304 | 12/1983 |
| WO | 99/15887 | 9/1998 |

OTHER PUBLICATIONS

Prof. Dr.-Ing. H.J. Thomas, "Thermische Kraftanlagen", 2. Auflage, 1985, Springer Verlag.
"Technische Formeln für die Praxis", 24. Auflage, 1984 VEB Fachbuchverlag Leipzig.

* cited by examiner

*Primary Examiner*—Hoang Nguyen
(74) *Attorney, Agent, or Firm*—Harness, Dickey & Pierce, P.L.C.

(57) ABSTRACT

A method and a device are for operating a steam turbine in which includes several no-load or light-load phases. All phases are supplied with steam in order to ensure good preheating. The supply of a phase is selected in such a way that the phase produces the least possible output, preferably no output. The enthalpy differential between the entrance to and exit from the phase is thus preferably reduced to zero.

23 Claims, 2 Drawing Sheets

METHOD AND DEVICE FOR OPERATING A STEAM TURBINE COMPRISING SEVERAL NO-LOAD OR LIGHT-LOAD PHASES

This application is the national phase under 35 U.S.C. § 371 of PCT International Application No. PCT/EP01/05747 which has an International filing date of May 18, 2001, which designated the United States of America and which claims priority on European Patent Application number EP 00111692.0 filed May 31, 2000, the entire contents of which are hereby incorporated herein by reference.

FIELD OF THE INVENTION

The present invention generally relates to a method for operating a steam turbine, which has a plurality of stages. More preferably, it is directed to operating during idling or low-load operation, with steam being admitted to all the stages. It also generally relates to a device for distributing steam to individual stages of a steam turbine, preferably during idling or low-load operation, and in particular for carrying out the method mentioned.

BACKGROUND OF THE INVENTION

Steam turbines and their design problems are, in particular, presented in Prof. Dr.-Ing. H.-J. Thomas, "Thermische Kraftanlagen" [Thermal Power Installations], $2^{nd}$ Edition, 1985, Springer-Verlag. Details for calculating the enthalpy and further thermodynamic parameters can, for example, be extracted from "Technische Formeln für die Praxis" [Technical Equations for Practical Use], $24^{th}$ Edition, 1984, VEB Fachbuchverlag, Leipzig.

Further reduction in the starting times of steam turbines is continuously required. Shorter starting times can only be achieved if all stages have, as far as possible, the largest possible mass flow admitted to them at the same time. It is only by this admission that the preheating of the steam turbine necessary for the shortest possible starting time can be achieved. The power generated by the turbine due to the mass flow being admitted must not, however, exceed the idling load. If the idling load is exceeded, uncontrolled increases in the rotational speed of the steam turbine can occur. The total mass flow which can be supplied overall is, therefore, limited.

High windage powers occur at the exhaust-steam end of the high-pressure stage (HP stage) during idling or low-load operation. These high windage powers lead to high temperatures at the exhaust steam end. A large part of the mass flow must therefore be supplied to the high-pressure stage in order to prevent unallowably high temperatures. The low-pressure stage (LP stage), however, also demands a comparatively high mass flow, in particular where large low-pressure stage cross sections and new materials, for example titanium for the blading of the low-pressure stage, are employed. The medium-pressure stage (MP stage) also requires a part of the mass flow.

If the necessary, high mass flow is admitted to both the high-pressure stage and the low-pressure stage, the overall power generated is distinctly located above the idling power. Attempts have therefore been made to adjust the distribution of the mass flows, by use of preliminary calculation, in such a way that idling operation becomes possible. In this case, the mass flows through the high-pressure stage and the medium-pressure/low-pressure stage were distributed in such a way that the power was not located above the idling power required.

It was only overheating of the high-pressure stage which was avoided by monitoring the temperature occurring at the exhaust-steam end. Only a small mass flow was left for the medium-pressure/low-pressure stage. If the mass flow for the medium-pressure/low-pressure stage was not sufficient or if the temperature at the exhaust-steam end of the high-pressure stage exceeded a specified value, rapid partial shut-down of the high-pressure stage was initiated. In consequence, the high-pressure stage, at least, was only inadequately preheated. Because of this inadequate preheating, a longer starting time was necessarily involved.

SUMMARY OF THE INVENTION

An object of an embodiment of the present invention may be, therefore, to make available a method and a device which permit good preheating of all the stages of a steam turbine without exceeding the load at idling or that in low-load operation.

In a method, this object may be achieved—according to an embodiment of the invention—by an admission to a stage being selected in such a way that this stage delivers as little power as possible.

Steam can be admitted to all the stages of the steam turbine by way of the method according to an embodiment of the invention. The admission takes place in such a way that a stage delivers as little power as possible. This stage therefore generates only a small amount of power so that a comparatively large mass flow can be admitted to the remaining stages. All the stages are therefore reliably preheated so that short starting times can be realized.

The enthalpy of the steam at inlet into this stage and the enthalpy of the steam at outlet from this stage may be advantageously determined and the enthalpy difference between inlet and outlet may be advantageously minimized. The power delivered by a stage may be directly proportional to the enthalpy difference. By minimizing the enthalpy difference, therefore, the power delivered can be minimized at the same mass flow or even an increased mass flow.

According to an advantageous development, the temperature of the steam at inlet into this stage and the temperature of the steam at outlet from this stage may be measured and the enthalpy difference between inlet and outlet is determined, in particular calculated, from these temperatures. The temperature of the steam is easy to measure so that the measurement complexity is reduced.

In order to increase the accuracy, the pressure drop between the inlet into this stage and the outlet from this stage may be, advantageously, additionally measured and may be taken into account in the calculation of the enthalpy difference between inlet and outlet. The enthalpy of the steam flowing through the stage depends on both the pressure and the temperature. The enthalpy difference can be more accurately determined, in particular calculated, by taking account of pressure and temperature than it can by taking account of the temperature alone.

In another advantageous development, the enthalpy of the steam at inlet into this stage and the enthalpy of the steam at outlet from this stage are measured. A suitable method for measuring the enthalpy of steam is, for example, described in WO 99/15887 by the present applicant. This publication refers to DE-B 10 46 068 for determining the enthalpy of live steam, i.e. of superheated steam. In contrast, WO 99/15887 relates to a measurement and calculation method for determining the enthalpy of wet steam. In order to extract a sample, a partial volume flow of the wet steam is brought together with a reference gas so as to form a mixture and so that the liquid constituents of the partial volume flow evaporate completely. Using measured physical parameters, the enthalpy of the reference gas and the enthalpy of the mixture are determined and the enthalpy of the wet steam is calculated from them. The information revealed by WO 99/15887 and DE-B 10 46 068 is to be expressly encompassed in the content of the present application.

In an advantageous embodiment, the mass flow supplied to this stage is modified in order to minimize the enthalpy difference. The mass flow supplied generates power due to expansion in the front part of this stage. At the exhaust-steam end, the mass flow is compressed again and consumes power by this. By modifying the mass flow supplied, a balance can be found between the two processes and the enthalpy difference can be minimized by this.

The admission to this stage is advantageously regulated in such a way that this stage does not deliver any power. For this purpose, it is necessary to regulate to zero the enthalpy difference between inlet and outlet. The mass flow through this stage therefore provides no power and is only used for preheating. It is then possible to admit the complete mass flow to the further stages of the steam turbine in order to overcome the idling load. The maximum mass flow is therefore admitted to all the stages and they are preheated in an optimum manner. The starting times can therefore be substantially reduced.

In a device, for the achievement of an object, provision may be made according to an embodiment of the invention for the device to have a first measuring station for recording the enthalpy of the mass flow supplied to a stage, a second measuring station for recording the enthalpy of the mass flow emerging from this stage, a comparison unit for determining the enthalpy difference and a unit for adjusting the mass flow supplied to this stage.

The device according to an embodiment of the invention permits a determination of the enthalpy difference, either by use of a direct measurement of the respectively present enthalpies or by use of a measurement of parameters relevant to the enthalpy, such as pressure and temperature. The enthalpy difference determined can be regulated by use of the unit for adjusting the mass flow supplied.

BRIEF DESCRIPTION OF THE DRAWINGS

The invention is described in more detail below using exemplary embodiments which are represented in a diagrammatic manner in the drawings. In the drawings, the same designations have been used for similar components or components which are functionally identical. In the drawings.

DETAILED DESCRIPTION OF THE PREFERRED EMBODIMENTS

Figure 1:
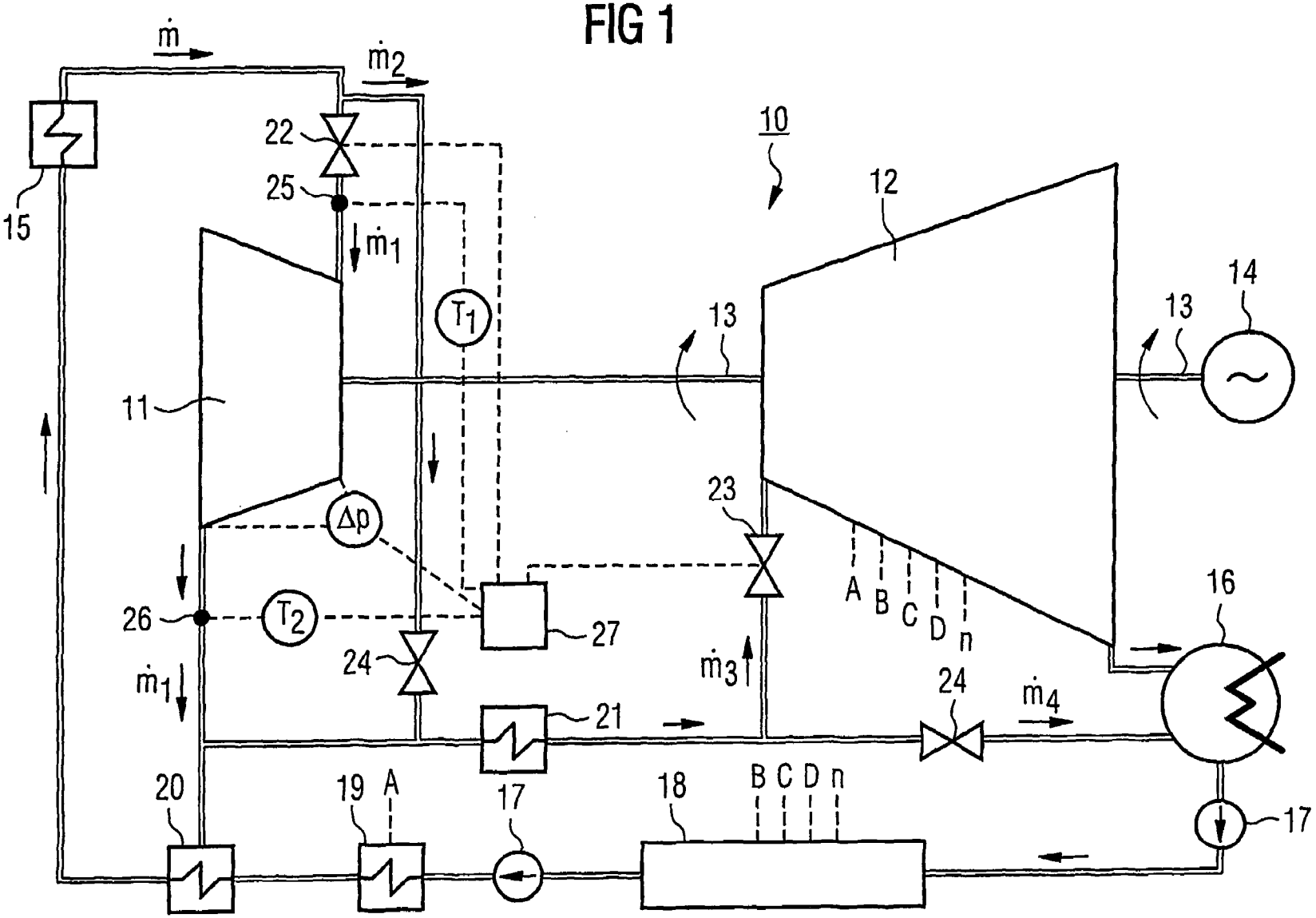
FIG. 1 shows a diagrammatic representation of a steam turbine.

FIG. 1 represents a steam turbine 10 with a high-pressure stage 11 and a combined medium-pressure/low-pressure stage 12. The stages 11 and 12 are connected together by means of a shaft 13, which drives a generator 14 in order to generate electrical current. The shaft 13 and the generator 14 can be decoupled from one another by use of an appliance, which is not represented in any more detail. A steam generator 15 is used for generating the steam necessary for operation and during idling. A condenser 16 for condensing the emerging steam is provided downstream of the medium-pressure/low-pressure stage 12. The condensate is returned to the steam generator 15 via pumps 17, a medium-pressure/low-pressure preheater 18 and two high-pressure preheaters 19 and 20. A reheat system 21 and a feed-water preheating system A, B, C, D, n are provided to increase the efficiency during operation. The components mentioned, and their functions, are known to the specialist so that it is possible to dispense with a more detailed explanation.

The steam generator 15 makes available a mass flow $\dot{m}$. The mass flow $\dot{m}$ is subdivided upstream of the high-pressure stage 11. A first mass flow $\dot{m}_1$ is supplied to the high-pressure stage 11, while the remaining mass flow $\dot{m}_2$ is supplied directly to the reheat system 21, bypassing the high-pressure stage 11. A mass flow $\dot{m}_3$ is admitted to the medium-pressure/low-pressure stage 12. The remaining mass flow $\dot{m}_4$ is guided directly to the condenser 16, bypassing the medium-pressure/low-pressure stage 12. Valves 22, 23 and 24 are used for adjusting the mass flows $\dot{m}_1$ and $\dot{m}_3$. The mass flows $\dot{m}_2$ and $\dot{m}_4$ follow automatically from the adjustment of the mass flows $\dot{m}_1$ and $\dot{m}_3$.

A first measuring station 25 is provided upstream of the high-pressure stage 11 and a second measuring station 26 is provided downstream. In the case of the usual assumption of an isentropic expansion, the power P generated by the high-pressure stage 11 is given by:

$$P=\dot{m}_1(h_2-h_1)=\dot{m}_1\Delta h$$

where $\dot{m}_1$ is the mass flow $h_1$ is the enthalpy at measuring station 25

$h_2$ is the enthalpy at measuring station 26

$\Delta h$ is the enthalpy difference between measuring stations 26 and 25.

Because the mass flow $\dot{m}_1$ through the high-pressure stage 11 is constant in steady-state operation, the power P is directly proportional to the enthalpy difference $\Delta h$. With the exception of mechanical losses, this power is also delivered. In order to minimize the power P delivered, it is therefore necessary to minimize the enthalpy difference $\Delta h$, if possible bringing it to $\Delta h=0$.

In the exemplary embodiment represented in FIG. 1, the temperature $T_1$ of the mass flow $\dot{m}$1 entering as steam into the high-pressure stage 11 is measured at the measuring station 25. A temperature measurement takes place downstream at the measuring station 26, a temperature $T_2$, the exhaust steam temperature from the high-pressure stage 11, being determined at this measuring station 26. The pressure difference $\Delta p$ between the measuring stations 25 and 26 is advantageously determined simultaneously by use of suitable pressure measuring appliances (not specified in any more detail). The measured temperatures $T_1$ and $T_2$, together with the measured pressure difference $\Delta p$, are supplied to a control unit 27, which calculates the enthalpy difference $\Delta h$ between the measuring stations 25 and 26.

The valve 22 is activated as a function of the result of the calculation, so that the mass flow $\dot{m}_1$ is regulated as a function of the calculated enthalpy difference $\Delta h$. This balance for the high-pressure stage 11 is essentially achieved by the exhaust steam temperature $T_2$ being held (by the control circuit 27, which provides a valve trimming dependent on the enthalpy) to a value which corresponds to the throttled live steam temperature. A mass flow $\dot{m}_1$ with a correspondingly throttled temperature $T_1$ is therefore made available and supplied to the high-pressure stage 11 by throttling the steam mass flow $\dot{m}$ by use of the valve 22. The throttling action (throttling effect) of the valve 22 is, in this arrangement, employed in a targeted manner in order to adjust the desired temperatures $T_1$ and $T_2$.

In this procedure, a calculation of the enthalpy difference $\Delta h$ is understood to mean not only the actual calculation of this enthalpy difference $\Delta h$ but also any other appropriate process, by which the enthalpy difference $\Delta h$ can be minimized. As an example, a comparison can be made with a table which is programmed within the control unit 27.

The enthalpy difference Δh determines the power P generated by the high-pressure stage. By means of the valve 23, therefore, the control unit 27 controls the mass flow $\dot{m}_3$ through the medium-pressure/low-pressure stage 12, corresponding to a specified idling load and the power generated by the high-pressure stage 11. Further measuring stations for recording temperature and/or pressure can be provided downstream of the reheat system or at other suitable positions in order to increase the accuracy.

Figure 2:
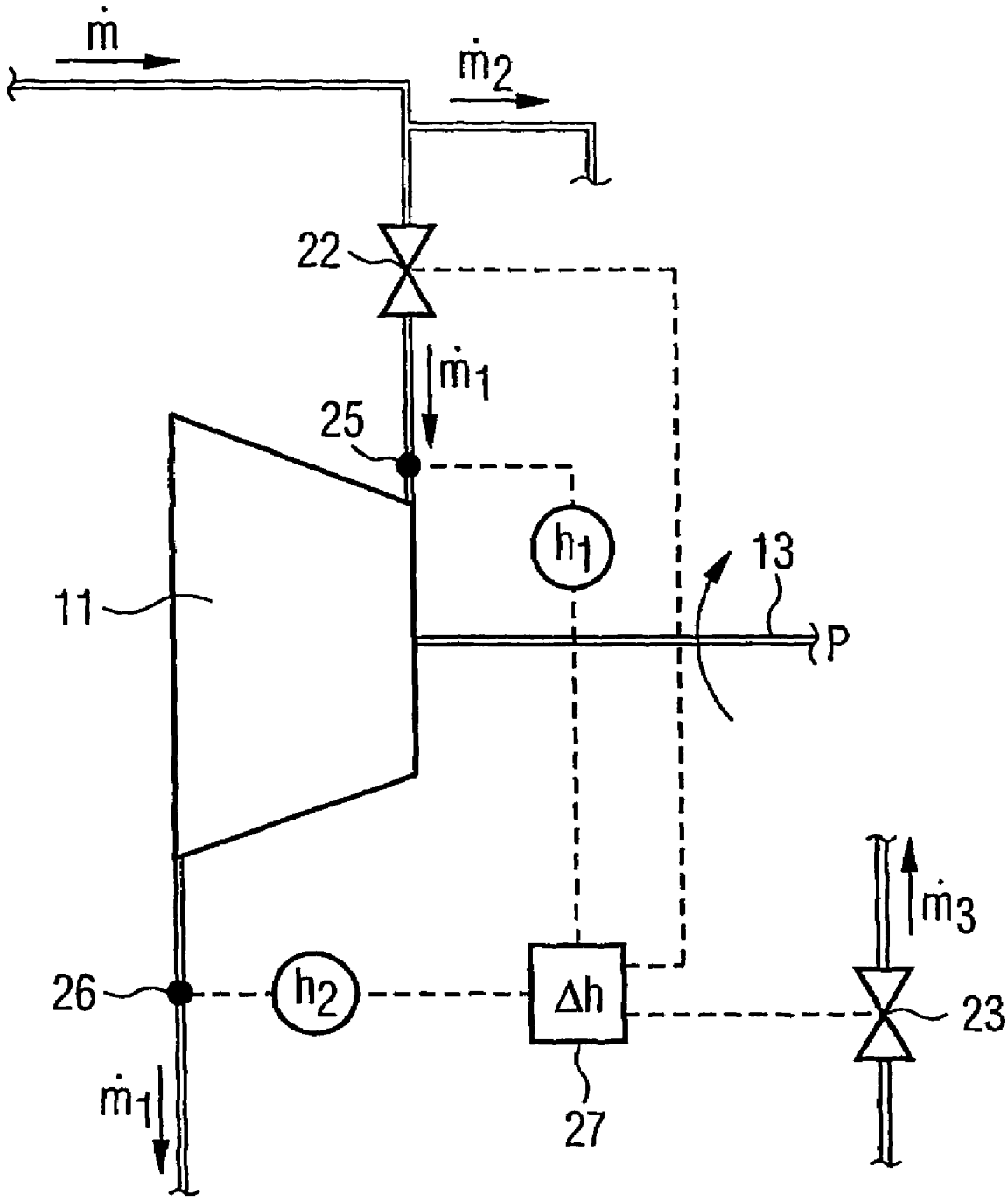
FIG. 2 shows an enlarged representation of the high-pressure stage, in a second embodiment.

FIG. 2 shows an enlarged representation of the high-pressure stage 11, together with the associated control of the mass flow $\dot{m}_1$. In the exemplary embodiment of FIG. 2, the enthalpies $h_1$ and $h_2$ are measured directly at the measuring stations 25 and 26 and the enthalpy difference Δh is subsequently formed in the control unit 27. The valves 22 and 23 are activated by the control unit 27 on the basis of the enthalpy difference Δh. By this, the power P delivered by the high-pressure stage 11 is minimized and the mass flow $\dot{m}_3$ through the medium-pressure/low-pressure stage 12 is simultaneously maximized.

The admission, provided according to an embodiment of the invention, to the high-pressure stage takes place in such a way that as little power P as possible, and advantageously no power at all, is delivered. The method permits an admission to all the stages 11 and 12 of the respectively maximum possible mass flow $\dot{m}_1$, $\dot{m}_3$. By this, good preheating of all the stages 11 and 12 and, therefore, short starting times are achieved. Exceeding the idling load and an unallowable increase in the rotational speed of the steam turbine 10 are reliably avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for operating a steam turbine including a plurality of stages, comprising:

admitting steam to each of the stages, wherein a stage which delivers as relatively little power as possible is selected for admission of steam, and wherein enthalpy of the steam at an inlet into the selected stage and enthalpy of the steam at an outlet of the selected stage are determined and the enthalpy difference between the inlet and the outlet is minimized.

2. The method as claimed in claim 1, wherein a temperature of the steam at the inlet into the selected stage and a temperature of the steam at the outlet from this stage are measured and the enthalpy difference between the inlet and the outlet is calculated from the temperatures.

3. The method as claimed in claim 2, wherein a pressure drop between the inlet into the selected stage and the outlet from the selected stage is additionally measured and is taken into account in the calculation of the enthalpy difference between the inlet and the outlet.

4. The method as claimed in claim 1, wherein enthalpy of the steam at the inlet into the selected stage and enthalpy of the steam at the outlet from the selected stage are measured.

5. The method as claimed in claim 1, wherein mass flow supplied to the selected stage is modified in order to minimize the enthalpy difference.

6. The method as claimed in claim 1, wherein the admission to the selected stage is regulated in such a way that the stage does not deliver any power.

7. A device for distributing steam to individual stages of a steam turbine, comprising:

a first measuring station for recording enthalpy of a mass flow supplied to a stage;

a second measuring station for recording enthalpy of a mass flow emerging from the stage;

a comparison unit for determining an enthalpy difference; and a unit for adjusting the mass flow supplied to the stage.

8. The method as claimed in claim 1, for operating a steam turbine, including a plurality of stages, during at least one of idling and low-load operation.

9. The method as claimed in claim 1, wherein mass flow supplied to the selected stage is modified in order to minimize the enthalpy difference.

10. The method as claimed in claim 1, wherein the admission to the selected stage is regulated in such a way that the stage does not deliver any power.

11. The method as claimed in claim 2, wherein mass flow supplied to the selected stage is modified in order to minimize the enthalpy difference.

12. The method as claimed in claim 2, wherein the admission to the selected stage is regulated in such a way that the stage does not deliver any power.

13. The method as claimed in claim 3, wherein mass flow supplied to the selected stage is modified in order to minimize the enthalpy difference.

14. The method as claimed in claim 3, wherein the admission to the selected stage is regulated in such a way that the stage does not deliver any power.

15. The method as claimed in claim 4, wherein mass flow supplied to the selected stage is modified in order to minimize the enthalpy difference.

16. The method as claimed in claim 4, wherein the admission to the selected stage is regulated in such a way that the stage does not deliver any power.

17. The method as claimed in claim 5, wherein the admission to the selected stage is regulated in such a way that the stage does not deliver any power.

18. The device as claimed in claim 7, wherein the device is for distributing steam to individual stages of a steam turbine during at least one of idling and low-load operation.

19. A device for carrying out the method of claim 1.

20. A device for distributing steam to individual stages of a steam turbine, comprising:

first measuring means for recording enthalpy of a mass flow supplied to a stage;

second measuring means for recording enthalpy of a mass flow emerging from the stage;

comparison means for determining an enthalpy difference; and means for adjusting the mass flow supplied to the stage.

21. The device as claimed in claim 20, wherein the device is for distributing steam to individual stages of a steam turbine during at least one of idling and low-load operation.

22. A method for distributing steam to individual stages of a steam turbine, comprising:

recording enthalpy of a mass flow supplied to a stage;

recording enthalpy of a mass flow emerging from the stage;

determining an enthalpy difference; and adjusting the mass flow supplied to the stage.

23. The method as claimed in claim 22, wherein the method is for distributing steam to individual stages of a steam turbine during at least one of idling and low-load operation.

* * * * *